US006951177B2

(12) United States Patent
Fischer et al.

(10) Patent No.: US 6,951,177 B2
(45) Date of Patent: Oct. 4, 2005

(54) BUTTONHOLE SEWING MACHINE

(75) Inventors: Jochen Fischer, Detmold (DE); Thomas Nöltge, Bielefeld (DE)

(73) Assignee: Dürkopp Adler Aktiengesellschaft, Bielefeld (DE)

( * ) Notice: Subject to any disclaimer, the term of this patent is extended or adjusted under 35 U.S.C. 154(b) by 0 days.

(21) Appl. No.: 10/510,010

(22) PCT Filed: Dec. 19, 2003

(86) PCT No.: PCT/EP03/14627

§ 371 (c)(1),
(2), (4) Date: Sep. 29, 2004

(87) PCT Pub. No.: WO2004/070100

PCT Pub. Date: Aug. 19, 2004

(65) Prior Publication Data

US 2005/0103245 A1 May 19, 2005

(30) Foreign Application Priority Data

Feb. 6, 2003 (DE) ..... 103 04 821

(51) Int. Cl.[7] ..... D05B 3/08
(52) U.S. Cl. ..... 112/68; 112/70
(58) Field of Search ..... 112/68, 70, 65, 112/73, 447, 475.25

(56) References Cited

U.S. PATENT DOCUMENTS

| | | | | |
|---|---|---|---|---|
| 2,247,305 A | | 6/1941 | Morgan | |
| 6,047,654 A | | 4/2000 | Kaufhold | |
| 6,095,066 A | | 8/2000 | Nöltge et al. | |
| 6,142,087 A | | 11/2000 | Pofalla et al. | |
| 6,220,192 B1 | | 4/2001 | Kähler et al. | |
| 6,722,299 B2 | | 4/2004 | Nöltge et al. | |
| 6,755,139 B2 | * | 6/2004 | Pannwitz et al. | 112/66 |
| 2003/0226485 A1 | | 12/2003 | Filges et al. | |
| 2003/0226486 A1 | | 12/2003 | Filges et al. | |

FOREIGN PATENT DOCUMENTS

| | | |
|---|---|---|
| DE | 291 197 | 5/1914 |
| DE | 197 16 631 | 10/1998 |
| DE | 198 07 771 | 4/1999 |
| DE | 199 16 660 | 6/2000 |
| DE | 100 85 290 | 12/2002 |
| DE | 102 25 511 | 6/2003 |
| DE | 102 25 512 | 7/2003 |
| GB | 10 038 | of 1915 |
| JP | 07313770 | 12/1995 |

* cited by examiner

*Primary Examiner*—Peter Nerbun
(74) *Attorney, Agent, or Firm*—McGlew and Tuttle, P.C.

(57) ABSTRACT

A buttonhole sewing machine comprises a top arm (1) with a needle (6) movable in up and down reciprocation and a base plate (2). A buttonhole cutting device (13) is provided, having a knife (36) which is disposed on the base plate (2) and comprises a straight cutting edge (37) that extends in the y direction and an eye cutting edge (38). A cutting block (15) cooperates with the knife (36). The knife (36) and the cutting block (15) are motor-adjustable one in relation to the other in the y direction.

12 Claims, 5 Drawing Sheets

BUTTONHOLE SEWING MACHINE

BACKGROUND OF THE INVENTION

1. Field of the Invention

The invention relates to a buttonhole sewing machine according to the preamble of claim 1.

2. Background Art

German patent 291 197 teaches a buttonhole sewing machine of the generic type, which has a buttonhole cutting device comprising knives of varying shape and size that are disposed in the base plate. Depending on the desired shape of a buttonhole, the corresponding knife can be selected from a plurality of knives of revolver-style arrangement. A device of this type is rather complicated.

U.S. Pat. No. 2,247,305 teaches a device for the production of buttonholes. In this case, a knife cooperates with a cutting block, the length of engagement i.e., the length by which the cutting block and the knife overlap, being adjustable so that buttonhole incisions of varying length can be cut. This design is complicated and not sufficiently flexible.

DE 100 85 290 T1 describes a buttonhole sewing machine which includes an eye-type-buttonhole cutting device. Cuts of varying shape and size can be produced by several cutting motions of a knife.

SUMMARY OF THE INVENTION

It is an object of the invention to embody an buttonhole sewing machine of the generic type in such a way that a plurality of varying buttonholes can be cut, using only a single knife.

According to the invention, this object is attained by the features of the characterizing part of claim 1. The measures according to the invention enable varying kinds of buttonholes to the cut. It is possible to cut eye-type buttonholes with straight sections of varying length. Simple, straight buttonholes of varying length i.e., buttonholes that have no eye, can be cut. It is also possible only to cut eyes. According to the invention it is possible that either the knife or the cutting block is regulated, as a result of which the knife and cutting block are adjusted one in relation to the other. Claim 2 reflects a favorable design, enabling eye-type buttonholes to be cut that have each only one eye, with the eyes of the respective buttonholes being located at opposite ends of the straight section.

Claims 4 to 8 specify simple constructional measures of how to put the teaching according to the invention into practice.

Claims 9 to 11 reflect favorable embodiments of how to accurately regulate parallelism of the knife and cutting block. With the cutting block being displaceable by some length, this measure becomes rather important.

Further advantages, features and details of the invention will become apparent from the ensuing description of an exemplary embodiment, taken in conjunction with the drawing, in which

DESCRIPTION OF THE PREFERRED EMBODIMENT

Figure 1:
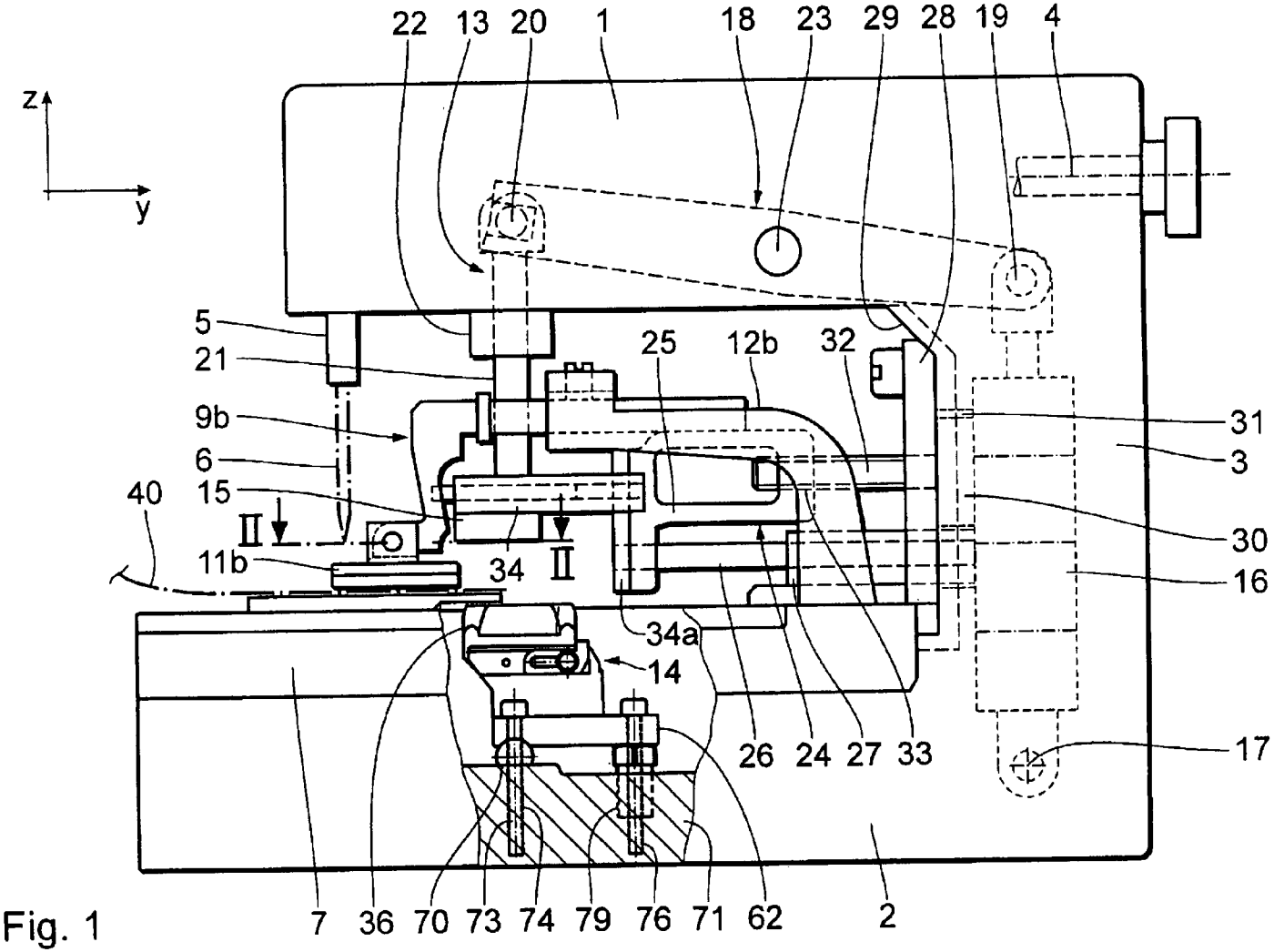
FIG. 1 is a longitudinal view of an eye-type buttonhole sewing machine with a buttonhole cutting device.
Figure 2:
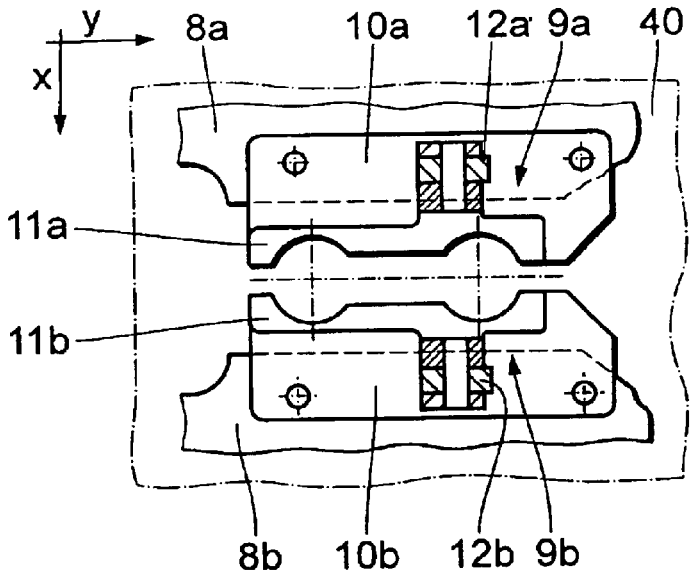
FIG. 2 is a horizontal sectional view of the sewing machine on the line II—II of FIG. 1 on an enlarged scale as compared to FIG. 1.

As seen in FIG. 1, a buttonhole sewing machine is C shaped, having a top arm 1, a bottom base plate 2 in the form of a casing and an approximately vertical standard 3 that unites both of them. An arm shaft 4 is conventionally mounted in the arm 1; it is drivable by a driving motor (not shown). The arrangement of a driving motor of this type on such a sewing machine is known from DE 102 25 511 A and DE 102 25 512 A. Actuation of a vertically displaceable needle bar 5 with a needle 6 and a jogging drive therefor are conventionally derived from the arm shaft 4.

An x-y table 7 is disposed on the base plate 2, which is a cross slide movable in two horizontal coordinate directions, namely the x direction and the y direction. The x-y table 7 is of customary design as known for example from DE 198 07 771 A1 (corresponding to U.S. Pat. No. 6,095,066 B). Actuation of the x-y table 7 takes place by means of drives (not shown), namely an x drive and a y drive, which are electric positioning motors, as a rule stepper motors, but may as well be variable speed D.C. motors. A design of this type is known from DE 102 25 511 A and DE 102 25 512 A.

A two-piece supporting plate 8*a*, 8*b* is disposed on the x-y table 7. A work piece clamp 9*a* and 9*b* is mounted on each sectional supporting plate 8*a* and 8*b*, having a sectional bearing plate 10*a* and 10*b* disposed on the respective supporting plate 8*a* and 8*b*, with a clamping plate 11*a* and 11*b* being allocated thereto. The clamping plates 11*a* and 11*b* are mounted on double-armed bearing levers 12*a* and 12*b*. Details of the structure and actuation of the work piece clamps 9*a*, 9*b* can be seen from DE 102 16 808 A (corresponding to U.S. Ser. No. 10/310,597), to which reference is made in this regard.

A buttonhole cutting device 13 is located downstream of the needle bar 5 seen in the y direction; it comprises a bottom cutter unit 14 which is stationary in the base plate 2, and a top cutting block 15. Allocated to the cutting block 15 is a cutting drive 16 in the form of a pneumatically actuated, multistage piston-cylinder drive, details of which are illustrated and described in DE 102 25 511 A and DE 102 25 512 A. The cutting drive 16 passes through the standard 3. The first bottom end of the cutting drive 16 is fixed to the base plate 2 by means of a joint 17. The second top end of the drive 16 is connected with a two-armed lever 18 by means of a joint 19, the lever 18 being articulated by means of a slide hinge 20 to a driving rod 21 which is vertically displaceably guided in at least one guide bearing 22 that is disposed in the arm 1. The two-armed lever 18 is pivotable approximately centrally about a horizontal pivoting axis 23 mounted in the arm 1.

The cutting block 15 can be set by the cutting drive 16 not only vertically, in the z direction, towards the cutter unit 14; it is also displaceable in the y direction i.e., in the longitudinal direction of the sewing machine. To this end, provision is made for a cutting-block positioning device 24 comprising a frame-type, horizontal cutting-block slide 25 which has guiding rods 26. These guiding rods 26 run in the y direction and are disposed in parallel and side by side in an x-y plane. They are displaceably guided in sliding bearings 27 which are fixed to a supporting plate 28. This supporting plate 28 is mounted on a wall 29 of the standard 3 that is turned towards the needle bar 5 and located between the arm 1 and the base plate 2. The supporting plate 28 is further provided with a servomotor 30 in the form of a stepper motor which projects into the standard 3 through a hole 31 in the wall 29 thereof. The guides formed by the guiding rods 26 and the sliding bearings 27 pass through this hole 31 too. The servomotor 30 has a spindle 32 as a driven shaft extending in the y direction; it passes through an internal thread, serving as a spindle nut 33, of the horizontal cutting-block slide 25. The spindle 32 and the spindle nut 33 constitute a spindle drive. Corresponding actuation of the servomotor 30 will displace the horizontal cutting-block slide 25 to and fro in the y direction.

On the side, turned away from the servomotor 30 and towards the driving rod 21, of the horizontal cutting-block slide 25, provision is made for a vertical cutting-block slide 34 which is displaceably vertically in the z direction and which is connected with the slide 25 by means of a z sliding connection in the form of a vertical guide 34*a*. The cutting block 15 is mounted on the bottom side of the vertical cutting-block slide 34. The driving rod 21 is coupled with the vertical cutting-block slide 34 by means of a y sliding connection 35 that extends in the y direction so that the cutting block 15 can be displaced in the y direction in relation to the driving rod 21 by means of the cutting-block positioning device 24, in spite of the driving rod 21 not being displaceable in the y direction.

Figure 6:
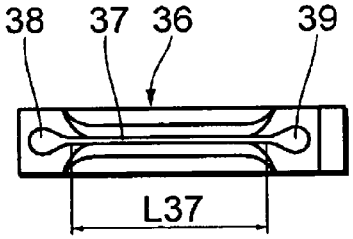
FIG. 6 is a plan view of a knife for buttonhole cutting.

On its top side turned towards the cutting block 15, the cutter unit 14 comprises a knife 36 which is replaceably mounted on the unit 14. As seen in FIG. 6, the knife 36 has a straight cutting edge 37 and, on the ends thereof, a first eye cutting edge 38 and a second eye cutting edge 39. The straight cutting edge 37 has a length L37 between the eye cutting edges 38, 39, which is equal to, or slightly exceeds, the length L15 of the cutting block 15. The cutting block 15 and the cutting edge 37 extend in the y direction.

Figure 7:
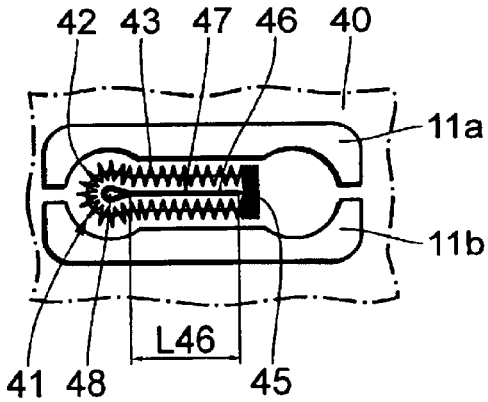
FIG. 7 is a plan view of the work-piece clamp with a work piece in which to produce an eye-type buttonhole in a first position.
Figure 8:
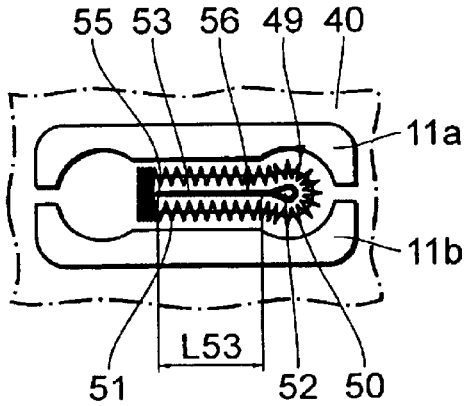
FIG. 8 is a plan view of the work-piece clamp with the work piece being provided with an eye-type buttonhole in a position that is side-inverted as compared to FIG. 6.
Figure 9:
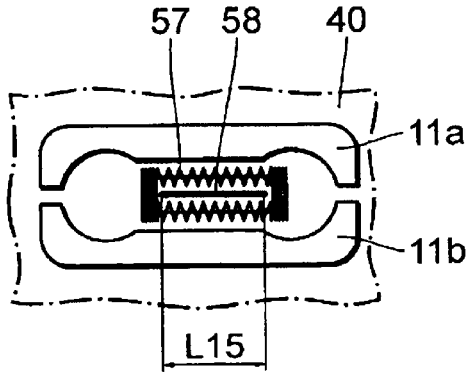
FIG. 9 is a plan view of the work-piece clamp with a work piece where a simple buttonhole has been produced.

The mode of operation will become apparent from FIGS. 7 to 9. The work piece clamp 9*a*, 9*b* holds a work piece 40 with the side turned downwards that will later be visible. For example, a first eye-type buttonhole seam 41 is sewn for a left-hand buttonhole (FIG. 7). Then the work piece 40 is conveyed by the x-y table 7 in the y direction, arriving in the buttonhole cutting device 13, such that the eye-type buttonhole seam 41 is located by its first eye-type seam 42 over the eye cutting edge 38 and by its straight seam 43 over the straight cutting edge 37. The servomotor 30 is actuated in such a way that the cutting block 15 is displaced by way of the spindle drive 32, 33 in the y direction towards the needle 6 to such an extent that its first edge 44, which is turned towards the vertical guide 34*a*, is located over the end 45 of the to-be-cut straight section 46 of the first eye-type buttonhole 47. Then the straight section 46 and the first eye 48 are accurately cut by actuation of the cutting drive 16.

Figure 3:
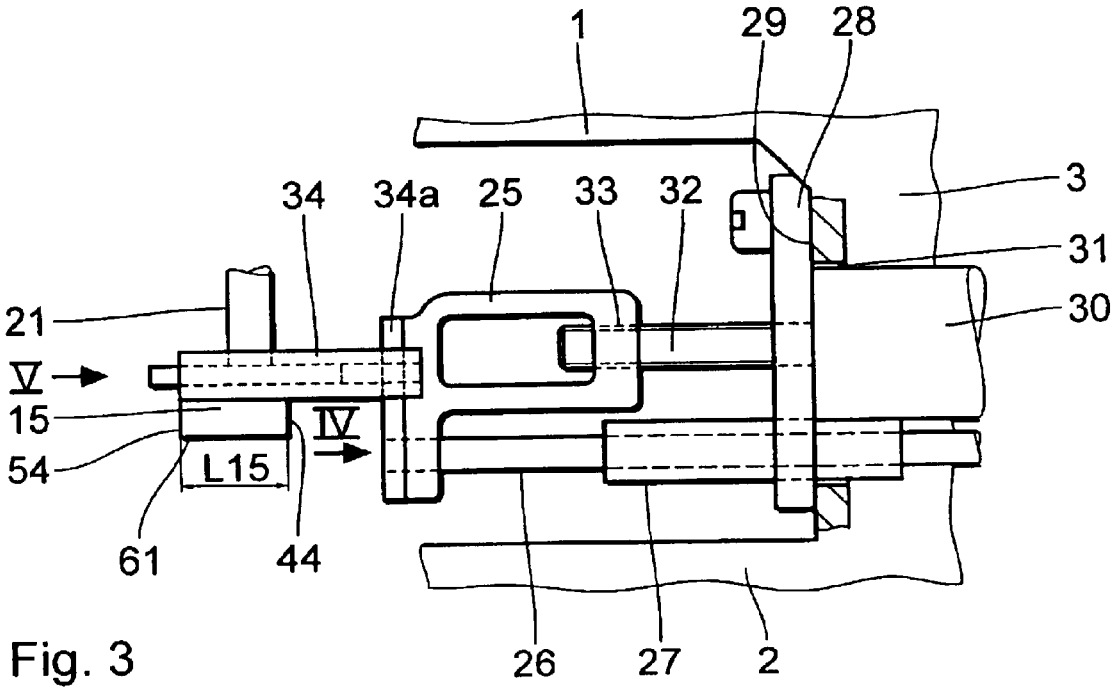
FIG. 3 is an illustration of a cutting-block positioning device of the sewing machine in a partial longitudinal view of the sewing machine.
Figure 4:
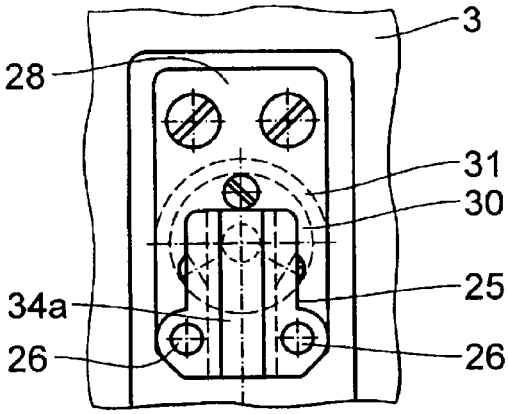
FIG. 4 is an elevation of the cutting-block positioning device in accordance with the arrow IV of FIG. 3.
Figure 5:
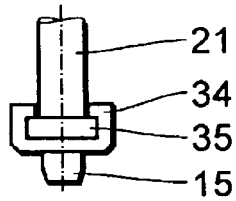
FIG. 5 is an elevation of the cutting-block positioning device in accordance with the arrow V of FIG. 3.

When a second eye-type buttonhole seam 49 (FIG. 8) is sewn, having a second right-hand eye-type seam 50 and a straight seam adjoining to the left, then the cutting block 15, for the second eye 52 and the adjacent straight section 53 to be cut, is displaced by the servomotor 30 into a position towards the servomotor 30 so that the second edge 54, on the left in FIG. 3, is located over the end 55 of the straight section 53 of the second eye-type buttonhole 56 that is to be cut. The total length of the eye-type buttonholes 47 and 56 can be freely selected by corresponding adjustment of the cutting block 15 i.e., the length L46 of the straight section 46 and the length L53 of the straight section 53 are variable.

If however only a straight buttonhole seam 57 (FIG. 9) is to be sewn, then the straight buttonhole 58 can only be cut to a length L15, because the cutting block 15 is adjusted by the positioning device 24 in such a way that it will hit only the straight cutting edge 37 of the knife 36 between the eye cutting edges 38, 39.

Figure 10:
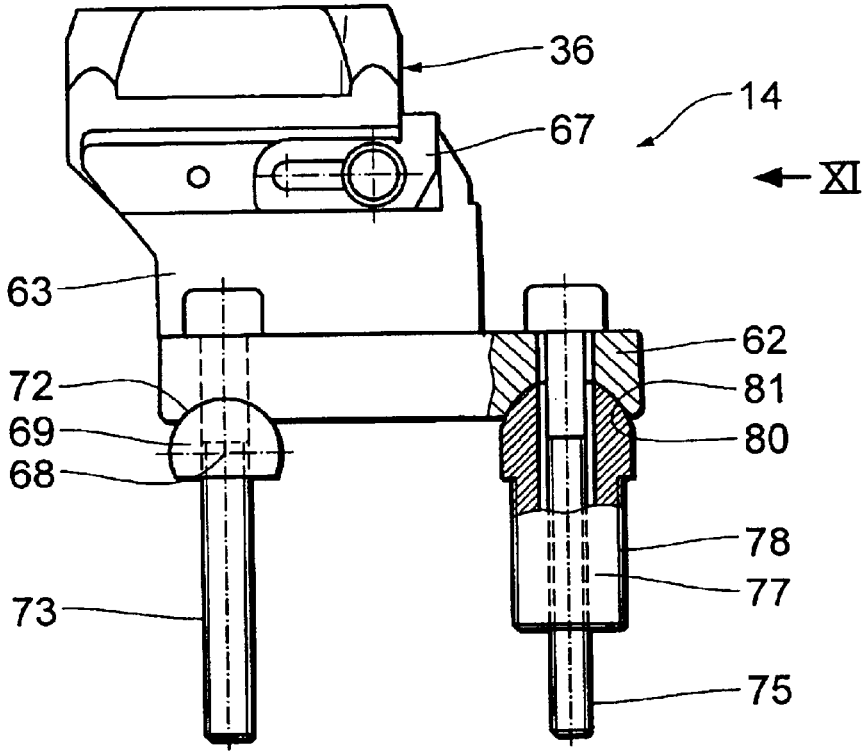
FIG. 10 is a longitudinal view, in accordance with the arrow X of FIG. 11, of a cutter unit provided with the knife.
Figure 11:
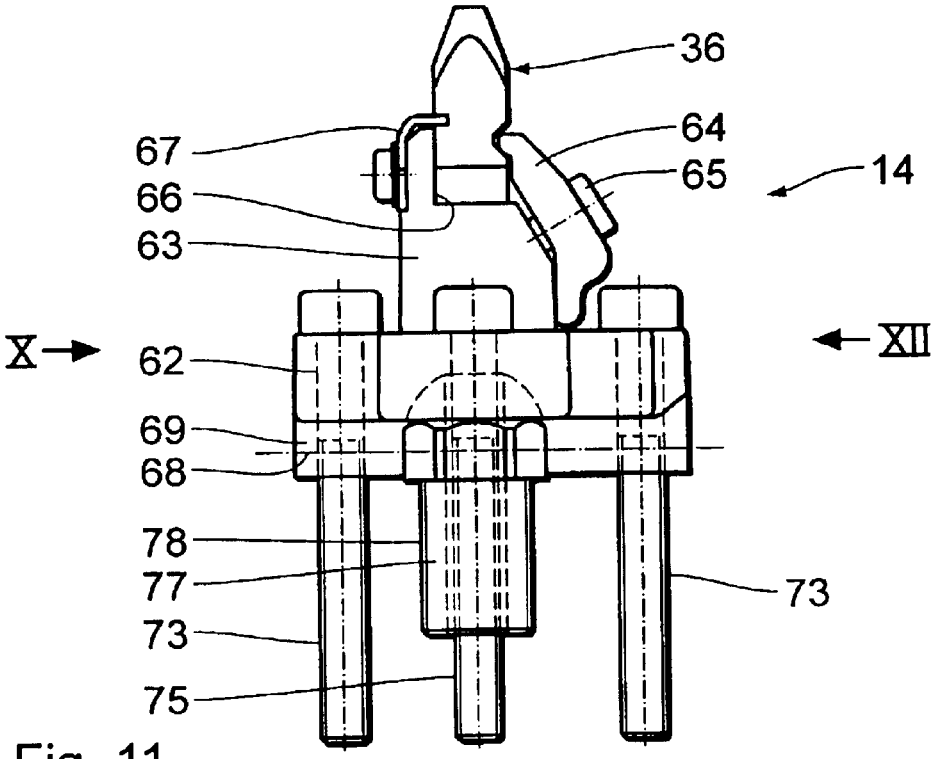
FIG. 11 is an elevation of the cutter unit in accordance with the arrow XI of FIG. 10.
Figure 12:
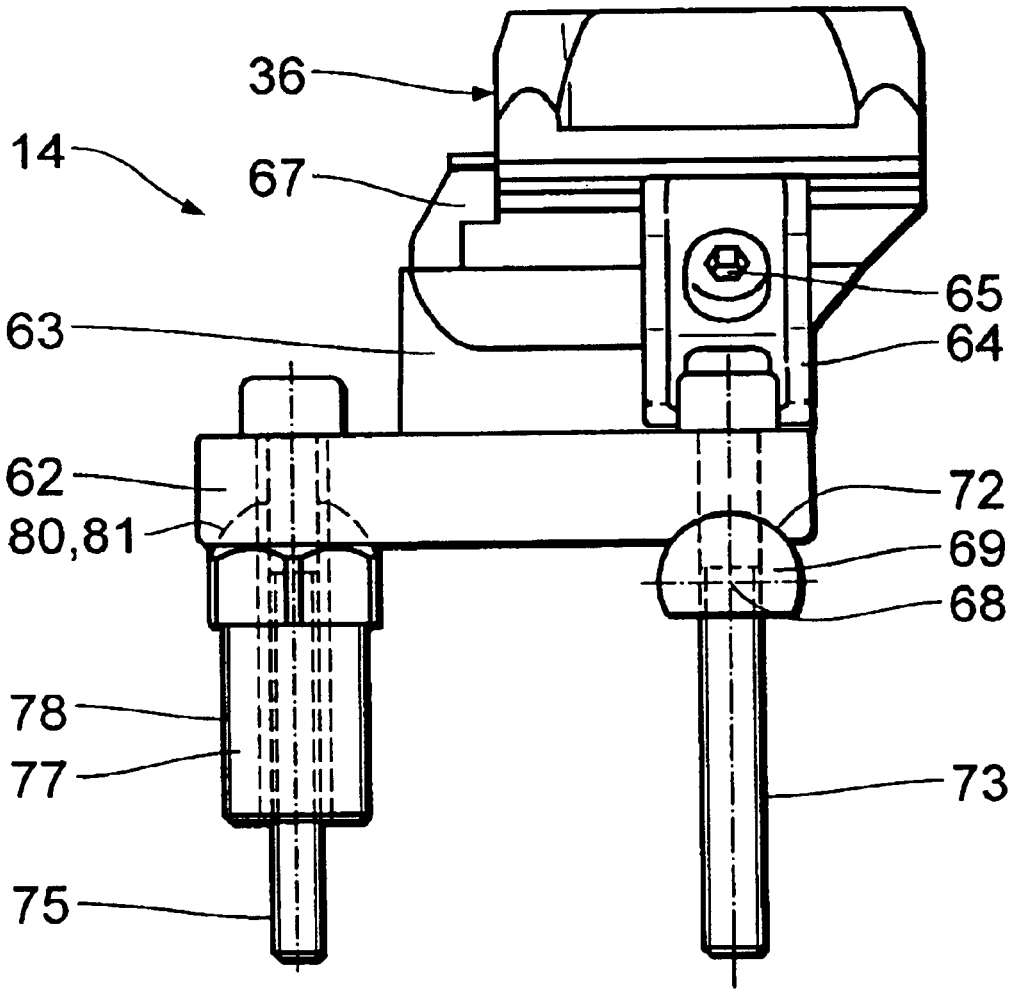
FIG. 12 is another longitudinal view of the cutter unit in accordance with the arrow XII of FIG. 11.

As seen in FIGS. 10 to 12, the cutter unit 14 is adjustable for the knife 36 to be parallel to the bottom pressure face 61 of the cutting block 15. To this end, the cutter unit 14 comprises a bottom seating plate 62, on which is mounted a knife bearing block 63. On this knife bearing block 63, the knife 36 is detachably held by a clamping jaw 64. To this end, the clamping jaw 64 is tightened by a screw 65, gripping on the knife and the knife bearing block 63. The clamping jaw 64 presses the knife 36 in the x direction and the z direction against a stop 66 of the knife bearing block 63. In the y direction, the knife 36 is held by frictional engagement between the knife 36 and the stop 66. A stop plate 67, which is displaceable in the y direction, is provided for alignment. The knife 36, when clamped, is stationary relative to the seating plate 62.

The seating plate 62 can be pivoted about an axis that extends in the x direction, it being possible thereby to set the mentioned parallel position of the knife 36 and the pressure face 61. By way of a sectionally cylindrical bearing bolt 69, the seating plate 62 supports itself on a bearing area 70 of the bottom part 71 of the base plate 2. On its bottom side, the seating plate 62 has a sectionally cylindrical bearing face 72 that rests on the cylindrical portion of the bearing bolt 69.

The seating plate 62 is joined to the bottom part 71 by means of two fastening screws 73 which are screwed into corresponding threaded holes 74 in the bottom part 71 (FIG. 1). These two fastening screws 73 pass through the bearing bolt 69. The seating plate 62 is joined to the bottom part 71 by means of another fastening screw 75 which is screwed into a corresponding threaded hole 76 in the bottom part 71. The three fastening screws 73, 75 are arranged in the form of an isosceles triangle. The fastening screw 75 passes through a set screw 77 provided on the bottom side of the seating plate 62. Since the associated fastening screw 75 is spaced from the bearing bolt 69 in the y direction, the set screw 77 is spaced therefrom too. The bottom portion of the set screw 77 has an external thread 78, by means of which it can be screwed into a threaded hole 79 of the bottom part 71 that is in alignment with the threaded hole 76. With the set screw 77 being screwed varyingly deeply into the threaded hole 79, the seating plate 62 is pivoted on the bearing bolt 69 about the axis 68, it being possible thereby to adjust a position of the pressure face 61 parallel to the edge of the knife 36. Corresponding tightening of the fastening screw 75 will clamp and secure the set screw 77 in the adjusted position. Since the set screw 77, on its the top end, comprises a domed bearing section 80 that is supported in a corresponding domed bearing recess 81 of the seating plate 62, any faulty gripping upon alignment of the cutter unit 14 is avoided.

What is claimed is:

1. A buttonhole sewing machine, comprising a base plate (2), a top arm (1) and a standard (3) uniting the arm (1) and the base plate (2);

a needle (6) movable in up and down reciprocation;

at least one work piece clamp (9*a*, 9*b*) displaceable in a y direction;

a buttonhole cutting device (13), which is disposed downstream of the work piece clamp (9*a*, 9*b*) seem from the needle (6) in the y direction, which has a knife (36) that is disposed on the base plate (2), having a straight cutting edge (37) that extends in the y direction and an eye cutting edge (38) on one end, a cutting block (15) which cooperates with the knife (36), and a cutting drive (16) for displacement of the cutting block (15) in a vertical z direction towards the knife (36);

characterized in that the knife (36) and the cutting block (15) are motor-adjustable one relative to the other in the y direction.

2. A buttonhole sewing machine according to claim 1, characterized in that the knife (36) comprises an eye cutting edge (38, 39) at each end of the straight cutting edge (37).

3. A buttonhole sewing machine according to claim 2, characterized in that the length (L37) of the straight cutting edge (37) in the y direction equals or exceeds the length (L15) of the cutting block (15).

4. A buttonhole sewing machine according to claim 1, characterized in that the cutting block (15) is motor-adjustable in the y direction.

5. A buttonhole sewing machine according to claim 1, characterized in that a cutting-block positioning device (24) is provided for adjustment of the cutting block (15) in the y direction, the cutting block (15) being disposed thereon for displacement in the z direction.

6. A buttonhole sewing machine according to claim 5, characterized in that the cutting-block positioning device (24) comprises a horizontal cutting-block slide (25);

in that the horizontal cutting-block slide (25) is displaceable in the y direction by means of a servomotor (30); and in that the cutting block (15) is disposed on the horizontal cutting block slide (25) for displacement in the z direction.

7. A buttonhole sewing machine according to claim 6, characterized in that the cutting block (15) is disposed on a vertical cutting-block slide (34) which is guided on the horizontal cutting-block slide (25) for displacement in the z direction.

8. A buttonhole sewing machine according to claim 7, characterized in that the cutting drive (16) acts on the vertical cutting-block slide (25) by a y sliding connection.

9. A buttonhole sewing machine according to claim 1, characterized in that the knife (36) and the cutting block (15) are adjustable in parallel to each other.

10. A buttonhole sewing machine according to claim 9, characterized in that the knife (36) is pivotably adjustable about an axis (68) that extends in an x direction perpendicular to the y direction and to the z direction.

11. A buttonhole sewing machine according to claim 10, characterized in that the knife (36) is fixed to a seating plate (62) which is supported by way of a pivot bearing in the base plate (2) and the pivoted position of which is adjustable and fixable by means of a set screw (77).

12. A buttonhole sewing machine according to claim 11, characterized in that the pivot bearing is formed by a bearing bolt (69) which rests on the base plate (2) and on which the seating plate (62) rests by an adapted bearing face (72).

* * * * *